United States Patent [19]

Wallstén

[11] 4,133,917

[45] Jan. 9, 1979

[54] METHOD AND APPARATUS FOR COATING A MOVING WEB

[75] Inventor: Hans I. Wallstén, Lausanne, Switzerland

[73] Assignee: Inventing S.A., Lausanne, Switzerland

[21] Appl. No.: 717,188

[22] Filed: Aug. 24, 1976

[30] Foreign Application Priority Data

Aug. 26, 1975 [SE] Sweden ..... 75094623

[51] Int. Cl.[2] ..... B05D 3/12

[52] U.S. Cl. ..... 427/209; 118/404; 118/126; 118/405; 118/407; 118/413; 427/211; 427/356; 427/361

[58] Field of Search ..... 118/404, 405, 407, 413, 118/126; 427/209, 211, 356, 361

[56] References Cited

U.S. PATENT DOCUMENTS

| | | | |
|---|---|---|---|
| 3,070,066 | 12/1962 | Facher | 118/413 |
| 3,097,107 | 7/1963 | Martinek | 427/356 |
| 3,442,684 | 5/1969 | Wordham et al. | 118/126 X |
| 3,484,279 | 12/1969 | Clark et al. | 427/356 |

*Primary Examiner*—Michael R. Lusignan

*Attorney, Agent, or Firm*—Lerner, David, Littenberg & Samuel

[57] ABSTRACT

A method and apparatus for coating at least one face of a moving web, such as a paper web, in which the web is fed longitudinally at a speed in excess of 400 meters per minute between a movable support and a blade forming, with the movable support, a nip. The blade has a bevel at the point of contact with the web, and an excess of coating material is applied at one side of the web in the nip, the coating material having a dryness content exceeding 60% and/or a viscosity exceeding 1500 cp. The angle of the blade is controlled so that it extends at most 20° to the web and the bevel width, as measured in the direction of movement of the web, is at most 0.05 centimeters. Preferably, the blades are urged against the web with a force not exceeding 2 kgf per centimeter width of web.

9 Claims, 7 Drawing Figures

METHOD AND APPARATUS FOR COATING A MOVING WEB

BACKGROUND OF THE INVENTION

The present invention relates to a method and apparatus for coating a moving web, such as a paper web moving at a web speed in excess of 400 m/min., whereby a coating agent is applied in excess on one side of the web. According to one method, the coating agent has a dryness content exceeding 60% and/or viscosity exceeding 1500 cp, and is applied upstream of a pressure nip for distributing and applying the coating agent, the web being fed between two members forming the pressure nip, one of said members constituting a movable support such as a rotating roller and the other constituting a blade having a bevel operating on the web.

Several different methods and apparatus operating with a flexible blade to coat one side of a paper web are already known. In one known proposal a paper web is passed downwardly, the web partially surrounding a support roller rotating at the same speed as the paper web. A flexible blade secured in a blade holder and forming an acute angle to the paper web seen in the direction of movement of the paper web presses the paper web against the support roller. The coating agent is supplied in the space between the blade and the paper web so that a dam of coating compound is formed. The quantity of coating compound applied on the paper web is determined amongst other things by the force with which the blade presses the web against the support roller. According to another embodiment, which has recently been preferred, the paper web is passed between two rollers, one of which constitutes a support roller rotating at the same speed as the paper web and the other constituting an application roller. The support roller is usually placed above the application roller. In this case the paper web is caused partially to surround the support roller. The application roller rotates in either the same or the opposite direction relative to the direction of movement of the paper web and is adjustably journalled so that a suitable space is obtained between it and the paper web. The coating material is supplied in a suitable manner to the application roller which in turn applies an excess of coating material on one side of the paper web. A flexible blade, secured in a suitable manner by a blade holder, presses the paper web against the support roller some distance downstream of the application point for the coating material. The excess coating material is thus scraped away and can be returned to the system in any suitable manner. At the same time uniform spreading and regulation of the desired application quantity of coating material on the web is obtained. The blade pressure can be set by suitable means. In a third known embodiment, similar to that just described, the movable application roller is replaced by a stationary means for applying coating material, said means being provided with an upper outlet slot through which the coating material is applied in excess on the paper web.

In all types of blade coating a spring-loaded blade presses against the paper web partly to scrape off excess coating material so that the requisite quantity of coating material remains on the paper, and partly to spread the material uniformly over the web. Due to the hydraulic forces caused by the relatively vigorous movement of the coating material during the coating process, a force is generated on the coating blade which counteracts the spring force of the blade itself. At high web speeds and/or high viscosities of the coating material, therefore, the spring force must be increased in order to compensate for the increased hydraulic pressure on the blade so that the desired quantity applied is obtained on the paper.

In all blade coating processes the blade edge angle, that is the angle between the blade edge and the web is acute. The reason for this is that a wedge action is then obtained so that particles, impurities and irregularities then pass more easily under the blade.

In all blade coating processes it is desirable to use coating materials having high dryness contents. This is partly because a coating material having high dryness content permits higher coating speeds without the requirement that the web subsequently pass through a drying section which is very large. Another advantage is that a smaller energy requirement is needed to dry off the water in the coating compound. Yet another advantage is that, for a certain coating speed, a smaller drying section can be used involving decreased investment and running costs. Thus, although it is always desirable to use coating materials with high dryness contents, there exists an upper practical limit for this. One reason is that a higher dryness content increases the risk of defects in the coated surface, primarily in the form of streaks. Another drawback is the increased risk of rupture when defects pass between blade and web, particularly when thin grades of paper are being coated.

The upper limit for the dryness content of the coating material is dependent on many factors, such as the type of coating material to be used for various reasons. The coating material generally consists of a dispersion of filler such as kaolin in water. The dispersion also contains binder and various additives. As mentioned earlier, streaks or stripes may easily occur in the coating layer if high dryness contents are used. Such streaks are of two distinct types: they may be mechanical or rheological. In both cases they are caused by solid particles or coagulated coating material which catches under the edge of the blade. The rheological stripes occur as follows: water in the coating material will be continuously transferred to a certain extent from the coating material to the base paper during its passage from the application point to the blade edge. Loss of water in the coating layer will thus cause an increase in the dryness content and therefore the viscosity of the coating material, resulting in coagulation due to the action of the cutting forces prevailing under the blade.

Although the risk of streaking can be reduced by a suitable choice of composition for the coating material, there is even here an upper practical limit. This limit varies considerably and is dependent on many factors. However, in general it may be stated that for conventional coating compositions the upper limit is around 60 - 65 for the dryness content, measured in percent by weight, although in certain cases even higher contents are possible. However, in such exceptional cases a special composition is necessary and the selection is thus limited, which is a drawback. As mentioned earlier, the manner in which the blade is arranged can also affect the risk of streaks. For instance, it is known that a small blade edge angle decreases the risk of streaks due to the wedge action. The various factors affecting the coating quantity applied in otherwise identical conditions are blade thickness, blade edge angle, pressure and the rheological properties of the coating material, etc.

Steel blades of spring steel having a thickness of between 0.25 mm and up to 0.70 mm are usually used for blade coating. The blade edge angle may be varied within wide limits. In most cases a blade edge angle of between 20 and 45 degrees is used but in many cases it has been found advantageous to use angles both smaller and larger. The blade is usually ground to a certain bevel before use and is mounted at a predetermined blade edge angle. Occasionally blades without a bevel are used. There are special occasions when extremely large quantities of coating material are required and the blade is then curved so much that the side of the blade lies parallel with the paper web. In this case there is no bevel at all. However, unless extremely large quantities are required a bevel is always used. In general, the more acute the blade edge angle the greater will be the quantity applied under otherwise identical conditions.

The spring force, in the following designated F, is selected taking into account the web speed and the viscosity of the coating material. The greater the speed and viscosity, the greater must be the spring force. The spring force is achieved by setting the blade holder in a suitable manner so that the blade is curved. The spring force is dependent on blade thickness, clamping length and elastic modulus. There are special arrangements in which the spring force can be increased by pressing on the blade between its attachment point and edge. The spring force is usually expressed in total force per unit width measured in the transverse direction of the web. The spring force, dependent on many factors, varies within wide limits. Within the speed range 300 - 700 m/min, using conventional coating compound with dryness contents around 60%, it is probably normally 0.5 - 1.5 kgf/cm width of the web. However, it has also been found that there is an upper practical limit for the spring force since the risk of web rupture increases if a high spring force is used, for instance, with a thick blade, possibly combined with short clamping length. When the blade is pressed away from the paper web during the starting instant, and the coating material has perhaps not completely covered the paper web, it is subjected to considerable strain since the hydraulic pressure is not fully developed and does not therefore completely counteract the spring force of the blade. In such cases the considerable strain on the paper during the starting instant may cause a web rupture.

BRIEF DESCRIPTION OF THE INVENTION

According to the present invention there is provided a method of coating at least one face of a moving web such as a paper web, comprising feeding the web longitudinally at a speed in excess of 400 meters per minute, between a movable support and a blade, which together form a nip, the blade having a bevel at the point of contact with the web, applying an excess of coating material on one side of the web in the nip, the coating material having a dryness content exceeding 60% and/or a viscosity exceeding 1500 c.p., controlling the angle of the blade, so that it extends at an angle of at most 20° to the web and choosing the bevel width, measured in the direction of movement of the web, to be at most 0.05 centimeters.

The invention also provides apparatus for coating at least one face of a moving web, such as a paper web, comprising means for moving the web at a speed in excess of 400 meters per minute between a moving support and a blade, forming with the moving support a nip, the blade having a bevel at the point of contact with the web, and means for supplying coating material to the nip to coat one face of the web, the bevel width, as measured in the direction of movement of the web, being at most 0.05 centimeters.

Preferably the blade edge angle should be less than 25° and the blades are urged against the web with a force less than 2 kgf/cm width of web.

BRIEF DESCRIPTION OF THE FIGURES

In order that the invention will be better understood, the following description is given, merely by way of example, with reference being made to the accompanying drawings, in which.

DETAILED DESCRIPTION OF THE INVENTION

Figure 1:
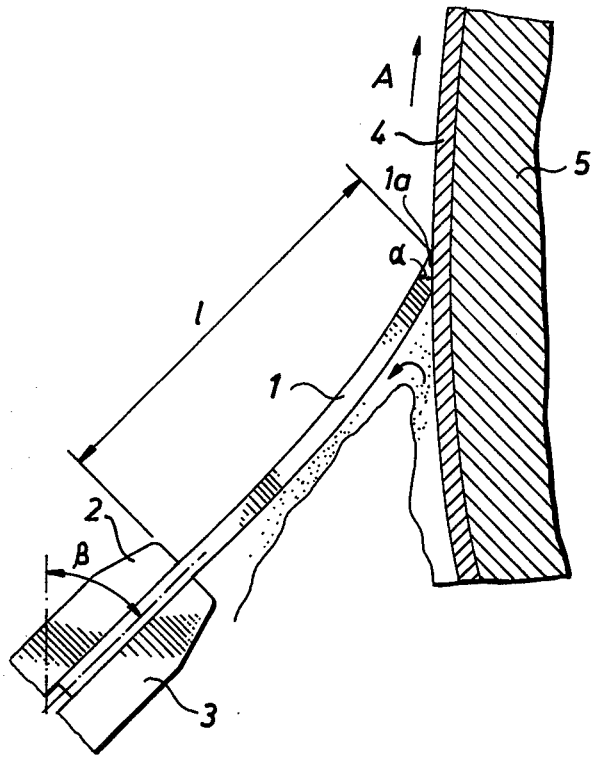
FIG. 1 is a schematic end view showing a conventional arrangement for coating a web.

FIG. 1 illustrates schematically how a coating blade is generally arranged. In this Figure the coating blade has been designated 1 and is clamped at its lower end between two collet jaws 2 and 3 of a blade holder. The blade is bevelled at its upper, free end, the bevel 1*a* being parallel with the paper web 4 which is pressed against a support roller 5. In use, the paper web 4 moves upwardly in the direction of the arrow A. The blade holder forms an angle $\beta$ in relation to the vertical plane. The angle between the blade edge and the bevel, termed the blade edge angle, is designated $\alpha$. The free length of blade, i.e. the distance between the clamping point and the blade edge is designated l.

Figure 2:
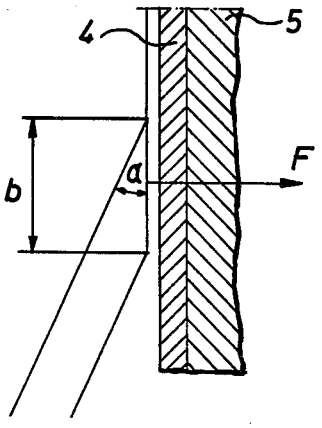
FIG. 2 is an enlargement of a portion of FIG. 1.

FIG. 2 shows an enlargement of a detail in FIG. 1. The width of the bevel, measured in the direction of movement of the web, is designated b. The force with which the blade presses against the paper web is designated F.

Figure 3:
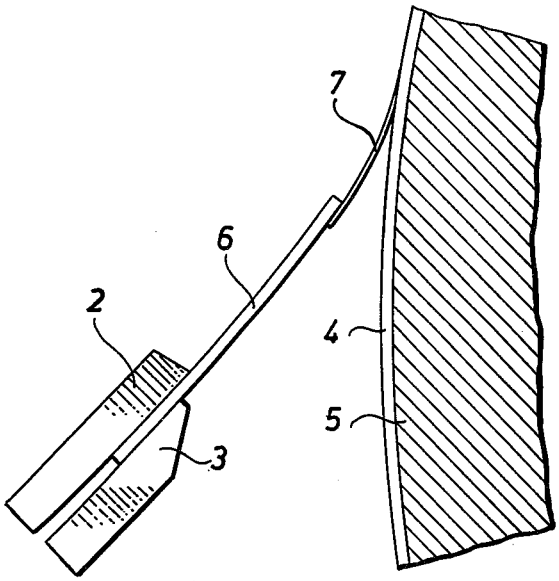
FIGS. 3 to 7 are similar views showing a number of different embodiments of the apparatus according to the invention.

In FIG. 3 the blade consists of a thicker, relatively stiff blade section 6 which is clamped in a blade holder comprising collet jaws 2 and 3. A slim, more flexible blade section 7, having a blade edge angle less than 20°, is secured in suitable manner to the blade section 6. The paper web is designated 4 and the counter-pressure roller 5. It has now unexpectedly been found that by using the means shown in FIG. 3 it is possible to coat paper with coating materials having extremely high dryness contents, but with very little risk of streaks. As an example it may be mentioned that using a means constructed in accordance with FIG. 3 with a blade thickness for the section 6 of 0.40 mm and a length measured from the clamping point of 25 mm, a blade thickness in the thinner section 7 of 0.1 mm and a free length of 5 mm measured from the clamping point on the thicker blade section, coating materials have been successfully used having dryness contents of up to 68% without the risk of streaks increasing over the level commercially acceptable in conventional blade coating. The web speeds reached 500 - 800 m/min and the viscosity of the coating material between 1500 and 3000 cp. In the examples given, the blade edge angle varied between 5° and 20°. The dryness content specified here must be considered extremely high in comparison with that normally possible with blade coating of conventional type. On the other hand, it would seem possible to use even high dryness contents assuming that a satisfactory dispersion can be achieved when preparing the coating compound. The importance of the effect reported above is obvious. Considerable advantages can be gained by using high dryness contents, as mentioned earlier, with respect to the capacity of the coating plant, investment costs and running costs. It has also been found that the quality of the result obtained can very well stand comparison with that obtained using conventional blade coating and corresponding considerably lower dryness contents for the coating material.

The effect obtained is entirely unexpected to one skilled in the art. It has so far been difficult to find an explanation for the effect achieved, but the following reasoning may perhaps serve to illuminate what might be imagined to occur when coating with the means described above. As mentioned previously, with conventional arrangement such as that shown in FIG. 1, the quantity of coating composition applied is dependent on the force with which the blade counteracts the hydraulic pressure created during the coating process. As also mentioned previously, when using coating materials having high dryness contents and at high web speeds, thick blades must be used, possibly combined with a short free length, in order to obtain sufficiently high force. As mentioned, there is a practical upper limit for this force. A relatively thick blade with relatively short clamping length, however, also has poor flexibility. By flexibility is meant the spring constant or spring ratio defined by the ratio between a load alteration in the free end of the blade and the alteration in position caused thereby. A certain flexibility is always desirable to allow for variations caused by defects in the paper web. The spring ratio is dependent on the elastic modulus, clamping length and manner of clamping (jointed support and permanent clamping or only permanent clamping) and the thickness of the blade.

After extensive experimentation it has been found that the quantity of coating composition applied is to a great extent dependent on the specific pressure (surface pressure) under otherwise identical conditions. On the other hand the quantity applied is less dependent on the spring force at the same surface pressure. The specific pressure is defined as the quotient of the spring force and the bevel width b per unit width of the blade (F/b per unit width of blade).

With the help of a special simulator it has been possible to measure the values of the specific pressure. With the embodiment according to FIG. 3 a relatively high specific pressure can be obtained without too much spring force. This offers the advantage that the high specific pressure enables a limitation of the quantity applied at high web speeds and with highly viscous coating compounds, since the quantity applied is to a considerable extent dependent on the specific pressure. On the other hand, the slim blade has relatively low spring force and good flexibility.

The extremely good flexibility presumably provides the explanation for the risk of streaks not increasing above the level which can be accepted commercially in spite of the use of coating materials having extremely high dryness contents and viscosities. Although this cannot be proved, it is likely that the great flexibility of the blade 7 in comparison with the conventional coating blade prevents the occurrence of streaks. Streaks caused mechanically, i.e. caused by loose particles on the surface of the paper, are able to pass more easily under a blade such as that described above. The same is probably also true for streaks caused by conglomerate in the coating compound which in turn may be caused by poor dispersion or other similar reasons. It even seems likely that the illustrated blade prevents the occurrence of streaks caused by the prevailing shear forces leading to coagulation.

However, yet another advantage is obtained by using the blade shown in FIG. 3. A limitation of the spring force can be obtained when coating with this means, thus eliminating the risk of web rupture due to defects in the paper web, particularly when using thin, weak grades of paper.

Figure 4:
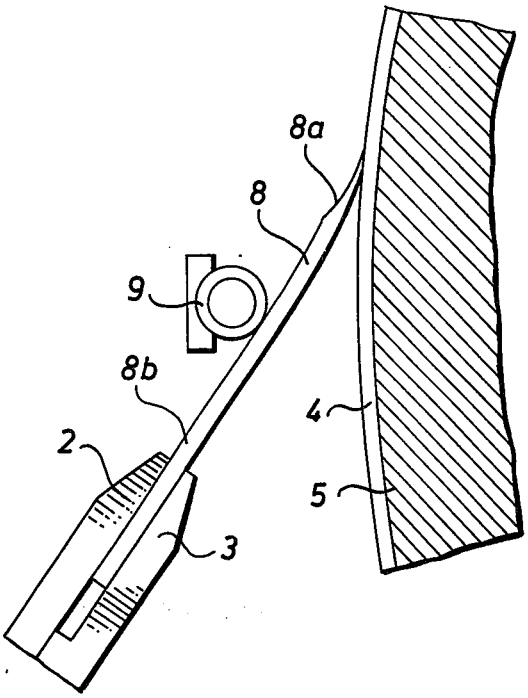

In the embodiment according to FIG. 4 a similar effect has been achieved by using a blade, designated 8, which is manufactured in one piece and by suitable machining been given a profile with an upper, thin, relatively flexible blade section 8*a* and a lower, thicker, relatively stiff blade section 8*b*. It is clear that the embodiment according to FIG. 4 gives a similar effect to that according to FIG. 3. The paper web has been designated 4 in FIG. 4 also. The blade 8 is clamped in a blade holder consisting of collet jaws 2 and 3, for instance. A tubular device 9 has also been indicated in FIG. 4, this being located between the stationary clamping point of the blade between the jaws and its free end. The tube 9 can be caused to provide a certain adjustable spring force by pressing on the blade, this being done by blowing in compressed air, for instance.

Figure 5:
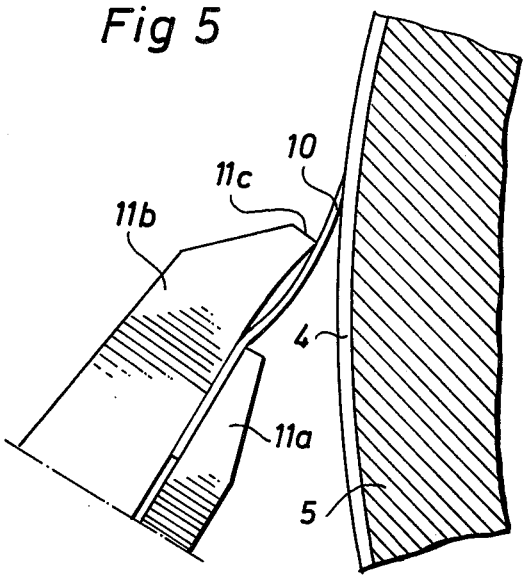

FIG. 5 shows another embodiment of the invention. Relatively high specific pressure is achieved here since a thin blade is used and the bevel width is therefore slight. In this case the blade is of uniform thickness and slim. However, an ordinary blade holder cannot be used since such a homogeneous blade must be relatively short. This would mean that if a blade holder were to be used having collet jaws as long as those in FIG. 4, at an increase in force at high speeds and high viscosities, the blade holder would come so close to the paper web that it would impede flow of the coating material. In the embodiment according to FIG. 5 the slim blade is secured between a lower collet jaw 11*a* and an upper collet jaw 11*b*. The upper jaw 11*b* is considerably longer than the lower jaw 11*a*. The slim blade 10 is thus firmly clamped between the jaws 11*a* and 11*b* while at the same time the blade rests on the upper edge 11*c* of the jaw 11. It has been found that such an embodiment also enables the combination of good flexibility with the requirement of high specific pressure and thin blade so that a slight bevel width is obtained. In all the embodiments according to FIGS. 3, 4 and 5 thin, flexible blades 7, 8*a* and 10 have been used to achieve satisfactory flexibility despite the need to counteract the high hydraulic pressure prevailing at high web speeds and viscous coating materials having high dryness contents in order to obtain the desired quantity applied.

Figure 6:
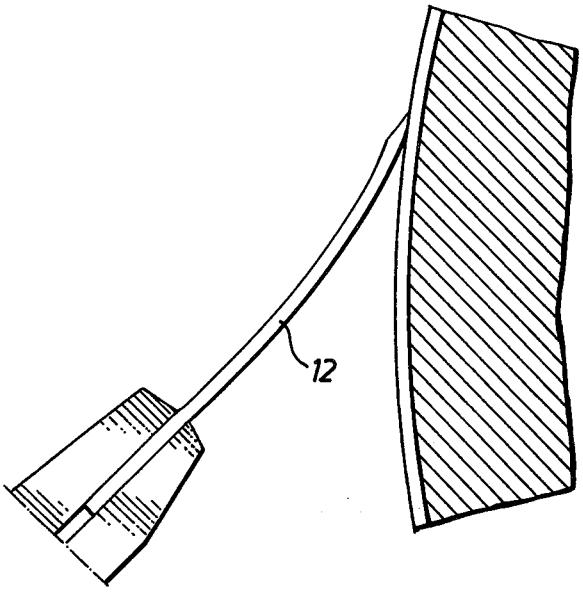

FIG. 6 shows an embodiment in which a relatively thick blade 12 is used, but where the bevel width is slight since the blade 12 has been ground in a special manner. It will be understood that even if the blade 12 in FIG. 6 has been made relatively thick, it can be given satisfactory flexibility due to the clamping length being sufficiently long. In this embodiment also, then, considerable flexibility can be combined with high specific pressure in order to permit coating at high web speeds while still being able to set the desired quantity applied.

Figure 7:
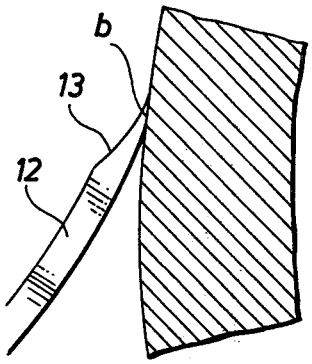

FIG. 7 shows an enlargement of the blade edge in the means according to FIG. 6. The ground surface 13 in FIG. 7 on the outside of the blade 12 with its bevel width b can be maintained substantially in spite of wear even after some time in operation, i.e. the quantity applied will be the same even after a relatively long time running. Although the embodiments according to FIGS. 3, 4 and 5 are to be preferred, the embodiment according to FIGS. 6 and 7 has certain advantages such as lower manufacturing costs, for instance. Obviously the blade 12 can be turned so that the surface 13 is facing inwards.

The following Table 1 give some examples of values measured and calculated when using the embodiments of the invention described in FIGS. 3 – 7. In all cases steel blades of spring steel having an elastic modulus of between $2.1 \times 10^6$ kgf/cm$^2$ and $2.2 \times 10^6$ kgf/cm$^2$ have been used. Paper of many different qualities has been tested, some qualities being thin and weak. Coating has been possible at high web speeds and with high dryness content and viscosity with a good coating result and without abnormal rupture frequency. The bevelled surfaces stated in the Table were produced by pre-grinding the blades. However, this is not essential. Even if the blade is not pre-ground a bevel will be formed due to wear after some time in operation.

TABLE 1

| Fig. No. | 3 | 3 | 4 | 5 | 5 | 6 |
|---|---|---|---|---|---|---|
| Free blade length mm | — | — | — | 7 | 10 | 35 |
| Support length mm | — | — | — | 13 | 13 | — |
| Blade thickness mm | — | — | — | 0.12 | 0.15 | 0.45 |
| Blade length, thin section mm | 4 | 4 | 5 | — | — | — |
| Blade length, thick section mm | 25 | 25 | 25 | — | — | — |
| Blade thickness, thin section mm | 0.1 | 0.07 | 0.12 | — | — | — |
| Blade thickness, thick section mm | 0.45 | 0.45 | 0.45 | — | — | — |
| Spring force (F) kgf/cm | 1.3 | 1.48 | 0.75 | 0.95 | 0.71 | 1.15 |
| Bevel width (b) cm | 0.042 | 0.04 | 0.027 | 0.038 | 0.044 | 0.025 |
| F/b kgf/cm$^2$ | 31 | 37 | 27.5 | 25 | 16 | 45 |
| Edge angle | 15 | 10 | 16 | 18 | 20 | 8 |
| Quantity applied g/m$^2$ on each side | 16 | 14 | 14 | 15 | 14 | 14 |
| Speed m/min. | 600 | 800 | 600 | 400 | 400 | 800 |
| Dryness content of compound % | 70 | 66 | 65 | 68 | 60 | 68 |
| Viscosity of compound centipoise | 3000 | 2000 | 1700 | 3000 | 1500 | 3000 |

It has been found that irrespective of which embodiment according to the invention is chosen from those shown in FIGS. 3 – 7, with a bevel angle not exceeding 20° and a speed in excess of 400 m/min, with a viscosity of the coating material above 1500 cp, the bevel width should not exceed 0.05 cm.

As mentioned before, the result obtained is surprising with respect to the risk of streaks when using extremely dry and viscous coating agents. Certain speculation has also been offered to explain the result obtained. However, it should be emphasised that this is only based on certain assumptions which can be made starting from the results obtained during the experiments. Starting with the values shown in Table 1, for instance, it can be established that the spring force can be limited although coating is performed using dry and viscous materials and high web speeds which, as is known, lead to extremely high hydraulic pressure. Limitation of the spring force is enabled by the strictly limited bevel width in accordance with the various embodiments of the invention. It should also be pointed out that acute blade edge angles are used. This probably results in good wedge action and further contributes to limiting the streak frequency.

The invention can be utilized irrespective of the manner in which the coating material is supplied on the paper web. The same applies to the method or means by which the blade is forced to press against the web in order to provide the requisite spring force. This can be achieved in many ways, known per se, such as by turning the blade holder, displacing it horizontally or by applying a load along the entire surface of the blade, for instance by providing an inner, closed space between blade and roller which is kept separate from the surroundings, the atmosphere, and maintaining different gas pressures in the inner and outer spaces in order to achieve the required pressure on the blade.

The result achieved is unexpected, as mentioned earlier. There are numerous factors which can affect the tendency to streak formation. For instance, the risk of streaks decreases if careful control of the coating material is observed, by selecting a suitable composition, giving it high water retention or low viscosity in relation to the dryness. It is also known that by suitable choice of base paper, or by pre-coating or surface-sizing the paper, it is also possible to reduce the tendency to streaking. However, according to the invention this result is achieved without such precautionary measures.

Coating on only one side of the paper web has been discussed here. The invention can of course be used to coat both sides of a paper web, in which case one side is coated first, dried in a subsequent drying operation, and then the other side coated in a similar manner and then subjected to drying.

I claim:

1. A method of coating at least one face of a moving web such as a paper web, comprising feeding the web longitudinally at a speed in excess of 400 meters per minute, between a movable support and a blade, which together form a nip, the blade having a bevel at the point of contact with the web, applying an excess of coating material on one side of the web in the nip, the coating material having a dryness content exceeding 60% and/or a viscosity exceeding 1500 c.p., controlling the angle of the blade, so that it extends at an angle of at most 20° to the web and choosing the bevel width, measured in the direction of movement of the web, to be at most 0.05 centimeters, said blade being urged against the web with a force not exceeding 2 kgf per centimeter width of web.

2. In an apparatus for coating at least one face of a moving web, such as a paper web, moving at a speed in excess of 400 meters per minute, in which the web is fed between a moving support and a blade, forming with the moving support a nip, the blade being thin and flexible and having a bevel at the point of contact with the web, in which coating material is supplied to the nip to coat one face of the web, the improvement consisting in that the bevel width, as measured in the direction of movement of the web, is at most 0.05 centimeters.

3. In an apparatus as claimed in claim 2, the improvement consisting in that the blade edge angle between the blade edge and the web is less than 20°.

4. In an apparatus as claimed in claim 2, the improvement consisting in that the apparatus further comprises means for pressing the blade into contact with the web, with a spring force less than 2 kgf per centimeter width of web.

5. The apparatus of claim 2 wherein said blade is formed of a first thick blade member; a support for holding one end of said thick blade member; a thin blade member secured to the free end of the thick blade member remote from said holder and having a thickness which is significantly less than the thickness of said thick blade member.

6. The apparatus of claim 5 wherein the thickness of said thin blade member is preferably between 0.1 and 0.15 mm.

7. The apparatus of claim 2 wherein said blade comprises a thick blade member; a holder for holding one end of said thick blade member; the free end of said thick blade member being machined so as to provide a portion of reduced thickness wherein said portion of reduced thickness is less than half the thickness of the remaining portion of said thick blade member.

8. The apparatus of claim 2 comprising a blade holder provided with first and second holding members for clamping one end of said blade therebetween; one of said holding members having an end extending beyond one end of the remaining one of said holding members and in the direction of the free end of said blade so as to bear against the portion of said blade located beyond the clamped portion of the blade to increase the biasing force imparted upon the blade by the holder.

9. The apparatus of claim 2 further comprising means positioned intermediate the clamped end of the blade and the free end of the blade for imparting an additional biasing force upon the blade.

* * * * *